US010427869B2

(12) United States Patent
Zugel

(10) Patent No.: US 10,427,869 B2
(45) Date of Patent: Oct. 1, 2019

(54) BAG RECEPTACLE HOLDER APPARATUS

(71) Applicant: Alan Zugel, Mukileto, WA (US)

(72) Inventor: Alan Zugel, Mukileto, WA (US)

( * ) Notice: Subject to any disclaimer, the term of this patent is extended or adjusted under 35 U.S.C. 154(b) by 0 days.

(21) Appl. No.: 15/822,892

(22) Filed: Dec. 11, 2017

(65) Prior Publication Data

US 2018/0370722 A1 Dec. 27, 2018

Related U.S. Application Data

(62) Division of application No. 15/048,517, filed on Feb. 19, 2016, now Pat. No. 9,828,175.

(60) Provisional application No. 62/118,267, filed on Feb. 19, 2015.

(51) Int. Cl.

| | |
|---|---|
| ***B65F 1/14*** | (2006.01) |
| ***B65F 1/06*** | (2006.01) |
| ***E01H 1/12*** | (2006.01) |

(52) U.S. Cl.

CPC ..... *B65F 1/1415* (2013.01); *B65F 1/06* (2013.01); *B65F 1/065* (2013.01); *E01H 1/1206* (2013.01)

(58) Field of Classification Search

CPC ..... B65F 1/1415; B65F 1/06; B65F 1/065; E01H 1/1206; E01H 1/12; E01H 2001/128; A01K 23/005

USPC ..... 294/1.4, 1.5

See application file for complete search history.

(56) References Cited

U.S. PATENT DOCUMENTS

| | | | | | |
|---|---|---|---|---|---|
| 3,872,834 | A * | 3/1975 | Fuhrman | A01K 15/003 | 119/801 |
| 3,977,422 | A * | 8/1976 | Cabaluna | A45B 3/00 | 294/1.4 |
| 4,196,928 | A * | 4/1980 | Spangler | A01D 51/00 | 15/104.8 |
| 5,971,452 | A * | 10/1999 | Marymor | A01K 23/005 | 294/1.5 |
| 6,305,322 | B1 * | 10/2001 | Patel | E01H 1/1206 | 119/161 |
| 8,684,429 | B1 * | 4/2014 | Holub | E01H 1/1206 | 294/1.4 |
| 9,668,457 | B1 * | 6/2017 | Irons | A01K 23/005 | |
| 2003/0085581 | A1 * | 5/2003 | Jemison | E01H 1/1206 | 294/1.4 |
| 2004/0080168 | A1 * | 4/2004 | Tsou | E01H 1/1206 | 294/1.4 |

(Continued)

*Primary Examiner* — Shawn M Braden

(74) *Attorney, Agent, or Firm* — Dean A Craine; Marisa C. Whitaker

(57) ABSTRACT

An apparatus used with a sleeve style receptacle to make an animal waste bag holder apparatus. The apparatus includes a cylindrical sleeve, a holder configured to temporarily hold a plastic bag inside the sleeve that includes a bolt that extends through a hole formed on the sleeve, a lock washer that attaches to the shaft to hold the shaft inside the side hole, a flange nut with internal threads that selectively attaches to the end of the shaft configured to press against the outside surface of the cylindrical sleeve. During use, a bag is inserted into the sleeve so the top edge of the bag fold over the sleeve and positioned adjacent to the hole. When the flange nut is tightened on the shaft, it eventually presses against the portion of the bag adjacent to the side hole. When further tightened, the flange nut pulls the portion of the bag around the shaft causing it to tighten around the sleeve.

2 Claims, 9 Drawing Sheets

(56) References Cited

U.S. PATENT DOCUMENTS

| | | | | |
|---|---|---|---|---|
| 2004/0201232 | A1* | 10/2004 | Borman | A01K 23/005 294/1.5 |
| 2006/0001281 | A1* | 1/2006 | Hubert | A01K 23/005 294/1.5 |
| 2007/0029828 | A1* | 2/2007 | Pilas | A01K 23/005 294/1.5 |
| 2009/0058114 | A1* | 3/2009 | Diehl | E01H 1/1206 294/1.4 |
| 2009/0102212 | A1* | 4/2009 | Casper | A01K 23/005 294/1.4 |
| 2012/0104780 | A1* | 5/2012 | Lloyd | E01H 1/1206 294/1.3 |
| 2014/0327256 | A1* | 11/2014 | Zurn | E01H 1/1206 294/1.4 |
| 2015/0164048 | A1* | 6/2015 | Spandau | A01K 23/005 294/1.5 |
| 2016/0244259 | A1* | 8/2016 | Zugel | B65F 1/1415 |

* cited by examiner

BAG RECEPTACLE HOLDER APPARATUS

This is a U.S. divisional patent application base on the U.S. utility patent application (application Ser. No. 15/048,517) filed on Feb. 19, 2016 which is based on and claims the filing date benefit of U.S. Provisional Patent Application (No. 62/118,267) filed on Feb. 19, 2015.

Notice is given that the following patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

This invention relates to devices that hold bags or buckets to allow waste or trash to be deposited.

2. Description of the Related Art

One drawback with caring for a domestic animal in a neighborhood or residential area is they generate animal excrement or waste material that must be picked up and properly discarded. If the animal defecates while on a walk, responsible owners will immediately pick-up the waste material and place it in a plastic bag and carry the plastic bag to a nearby disposal site. Sometimes, the owner must carry the plastic bag filled with waste material the entire walk.

Sometimes, the animal will defecate several times while on a walk forcing the owner to either carry multiple bags individually filled with waste material. Sometimes, the owner must repeatedly open and fill one bag with waste material.

If the animal defecates in the owner's yard, the owner normally picks up several piles of the waste material in the yard. It is convenient to use one plastic bag sufficiently large to hold large amounts of waste material.

The tasks of picking up and carrying animal waste material for proper disposable are one most unpleasant task for a dog owner. While plastic bags with wide opens are widely available and convenient, their plastic side walls are thin and flaccid enabling the heat and texture of the animal waste to be perceived through the bag when handled. Also, the bag's main opening must be held open to allow animal waste material to be deposited into the bag and not contact the owner's fingers.

It is common to install disposable plastic bags in a trash can. When the trash can is full, the plastic bag is removed from the trash can and deposited in a larger trash bin. A new plastic bag is then installed in the trash can.

Plastic bags for trash cans are manufactured in a long rectangular line with adjacent bags being separated by a perforated line. The line is wound into a large roll stored in a cardboard box. When needed, the bags are individually pulled from box, separated from the roll, expanded and then inserted to the trash can. Because the bag is a closed structure, air may be trapped between the inside surface of the trash can and the outside surface of the bag that prevents the bag from expanding and filling the enter trash can.

Sometimes the shape and size of the plastic bag does not match the size and shape of the trash can. The top edges of the plastic bag may not stretch around the top edge of the trash can. As the plastic bag is filled, the top edge of the plastic bag may fall into the trash can making future deposits of trash into the plastic bag difficult.

What is needed is a bag receptacle holder that securely holds a bag with a main opening sufficiently wide when unfolded and expanded to allow waste material to be easily deposited.

SUMMARY OF THE INVENTION

It is an object of the present invention to provide a bag receptacle holder that can be used to pick-up animal waste from the ground and deposit the waste material into a plastic bag or bucket.

It is an object of the present invention to provide a bag receptacle holder used with a receptacle that receives and holds a plastic bag or bucket in an open position to allow waste to be deposited into the plastic bag or bucket.

It is an object of the present invention to provide a bag receptacle holder that when used with a plastic bag is placed into a receptacle configured to allow the top edge of the plastic bag to be folded over the outer surface of a receptacle, captures the portion of the bag that extends over the outer surface of the receptacle and removes excess bag material to tightening the plastic bag around the receptacle.

It is an object of the present invention to provide a bag receptacle holder that may be inserted into a side hole formed on the side wall of a receptacle opened at one end that allows air to escape from the receptacle when a plastic bag is inserted into the receptacle's main opening allowing the plastic bag to be expanded into the receptacle.

The invention disclosed addresses the problem of temporarily holding and tightening a plastic bag in a receptacle that fits into the top opening of a receptacle and expands to at least fill the receptacle and rest against the inside surface of the receptacle's surrounding sidewalls. The invention solves this problem by forming a side hole on the sidewall of the receptacle, selecting holder comprising a bolt with a wide head and a threaded neck that extends through the side hole when the head is on the inside surface of a sidewall. The neck extends outward and is perpendicular from the outside surface of the sidewall. When the plastic bag is inserted through the receptacle's top opening, the top edge of the plastic bag is folded over the top edge of the receptacle and pulled over the outside surface of the receptacle so a portion of the top edge or the upper portion of plastic bag is positioned adjacent to the side hole. A wide flange nut is then attached to the end of the shaft and tightened until it presses against the portion of the plastic bag adjacent to the side hole. When the flange nut is further tightened, the portion of the plastic bag under the flange nut gripped and twisted to tightening the plastic bag on the receptacle. In the preferred embodiment, the top edge of the plastic bag extends on opposite sides of the side hole so the flange nut when tightened on the shaft pulls and twists the plastic bag in opposite directions around the outside surface of the receptacle.

In one embodiment, the receptacle is a cylindrical sleeve with a top opening, a bottom opening and a side hole. The holder includes a partially threaded bolt designed to fit into the side hole. The bolt includes a wide head placed on the inside surface of the sleeve and a threaded shaft that extends outward through the side hole. When a plastic bag is inserted through the sleeve's top opening and into the sleeve's center cavity, the top edge of the plastic bag is folded over the outside surface of the sleeve. The plastic bag has enough length to fit inside the sleeve and position the top edge at least adjacent to the side hole.

The holder also includes a wide flange nut with internal threads that attaches to the threaded shaft. The flange nut includes a wide inside surface configured to grip the portion of the plastic bag adjacent to the hole when the flange nut is forced against the receptacle and rotated. When the flange nut is further tightened on the shaft, the inside surface of the flange nut grips, pulls and twists the portion of the plastic bag adjacent to the hole around the outside surface of the sleeve. As the flange nut is rotated and tightened on the shaft, the layer of the plastic bag under the flange nut is pulled in opposite directions which tighten the entire plastic bag around the sleeve.

In one embodiment, the holder is attached to handle forming a tool used to pickup animal waste.

In another embodiment, the head of the bolt includes a side hole that communicates with an air conduit that extends the entire length of the shaft. When the bolt is attached to a receptacle, air trapped between the plastic bag and the inside surface of the receptacle may escape through the air conduit. The holder with an air conduit may be an accessory with a trash can with top opening, a closed end, and sidewalls. When a side hole is formed on the sidewall, that holder is attached to the side hole. When a plastic bag is inserted into the trash can that is configured to fold over the top edge of the trash can and extend to the side hole, trapped air in the space between the inside surface of the trash can and a plastic bag can escape enabling the plastic bag expand into the trash can. The flange nut on the holder is then used to securely pull, twist and tighten the plastic bag around the trash can.

DESCRIPTION OF THE PREFERRED EMBODIMENT(S)

Figure 1:
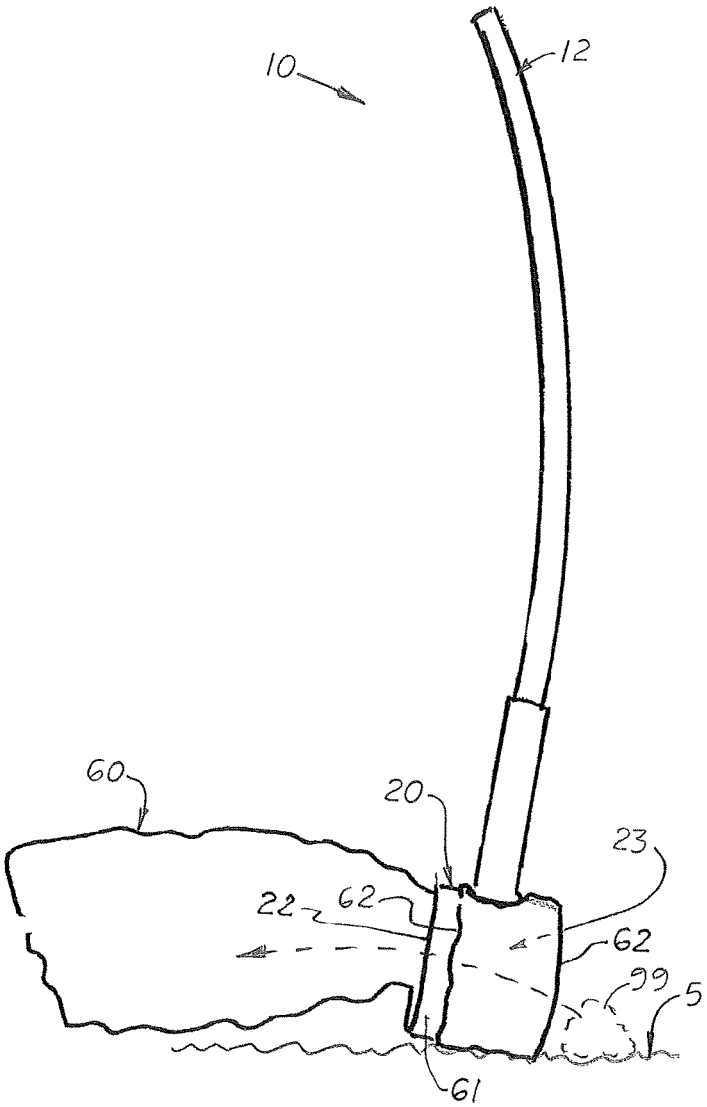
FIG. 1 is a side elevational view of a bag receptacle holder combined with a sleeve and elongated handle and used as a tool for removing animal waste material from the ground and depositing it into a bag.

Disclosed herein is a waste receptacle holder disclosed that attaches to a straight wall or curved wall receptacle designed to receive a plastic bag. The receptacle may be a thin wall sleeve 20 with top or bottom openings or a thin wall trash can 120. When a plastic bag 60 is installed on the center cavity 26, 126 formed in the sleeve 20 or trash can 120, respectively, the top edge 62, 62' of the plastic bag 60, 60' folds over the outside surface of the sleeve 20 or trash can 120. A side hole 24, 124, is formed on the sidewall of the sleeve 20 or trash can 120, respectively, at location so that top 62, 62' edge of the plastic bag 60 or trash can 120, respectively, when folded over the sleeve 20 or trash can 120 extends downward at least partially covers or adjacent to the side hole, 24, 124, respectively.

Referring to the FIGS. 1-7, the holder 8 is part of a tool 10 that includes a lightweight elongated pole 12 with the sleeve 20 attached or mounted on one end of the pole 12 that receives and holds a small plastic bag 60. The plastic bag 60 is enough in length and diameter to fit into the sleeve 20. The opposite end of the plastic bag 60 is closed. The sleeve 20 is cylindrical with two opposite end openings 22, 23. A side hole 24 is formed on the side wall. The sleeve 20 is made of thin flexible plastic and designed to bend and flex in FIGS. 3 and 4. When the sleeve 20 and the plastic bag 60 are forced downward against the ground 5, the sleeve 20 is reshaped into an oval cross-sectional configuration so that waste material 99 may be raked towards the top opening 23 sleeve 20 and into the plastic bag 60 in FIG. 1.

Figure 5:
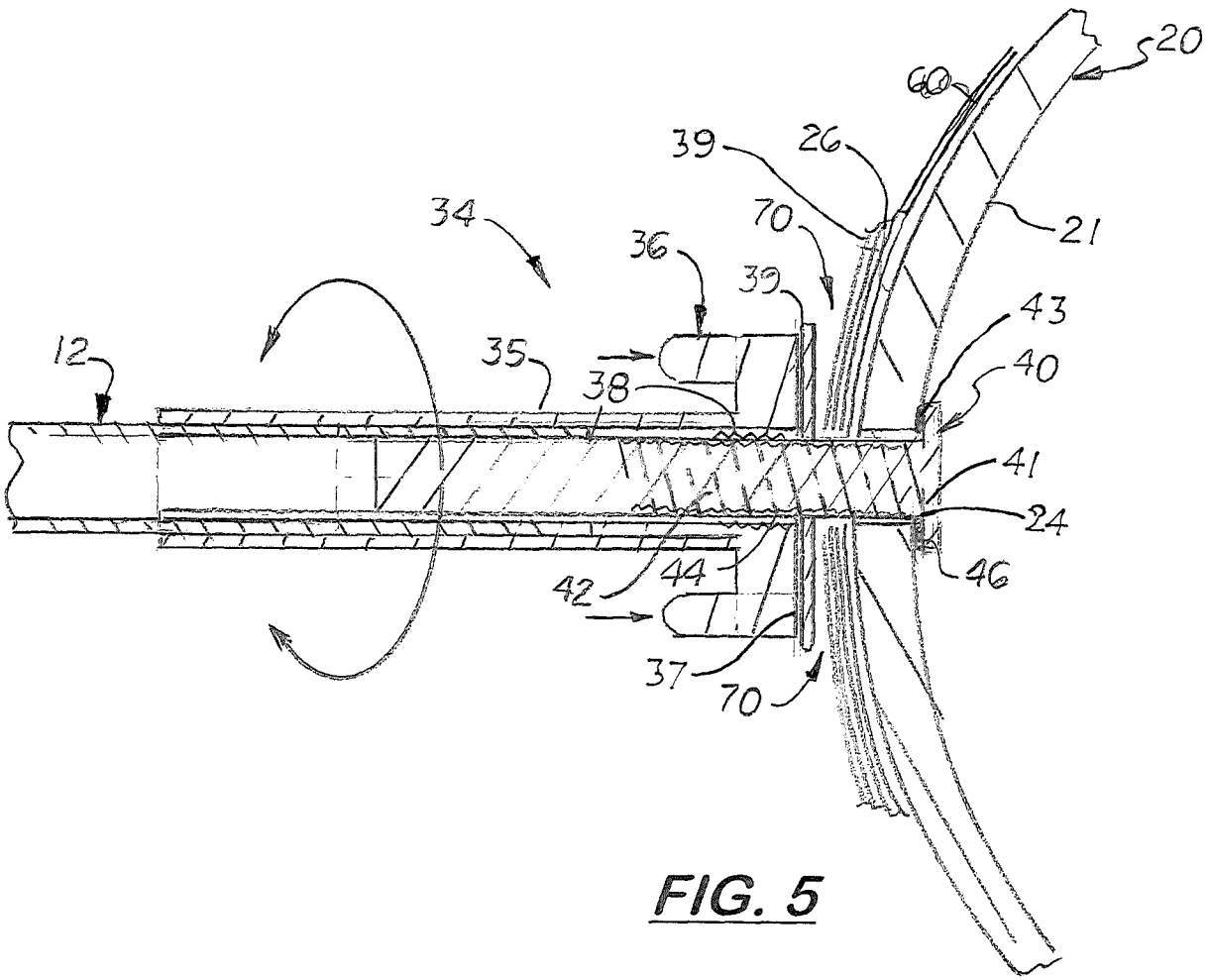
FIG. 5 is a partial side elevational view of the distal end of the pole and the sleeve showing the top edge of a bag being positioned in a gap formed between the flange and the outside surface of the sleeve.

As shown in FIG. 5, the holder 8 includes a partially threaded bolt 40 designed to fit into the side hole 24. The bolt 40 includes a wide head 41 and threaded shaft 42. The wide head 41 is placed on the inside surface 21 of the sleeve 20 and the threaded shaft 42 extends outward through the side hole 24. When a plastic bag 60 is inserted through the top opening 23, the top edge 62 of the plastic bag 60 is folded over the outside surface of the sleeve 60 and placed adjacent to extended passed the shaft 42. Disposed on the shaft 42 and adjacent to the inside surface of the wide head 41 is an optional flexible washer 39. Attached to the portion of the shaft 42 located adjacent to the outside surface of the sleeve 20 is a lock washer 48. During use the lock washer 48 is forced onto the shaft 42 and against the washer 39 or against the outside surface of the sleeve 20 to hold the shaft 42 securely in place on the sleeve 20.

The holder 8 includes a wide flange nut 36 with a center bore with internal threads 38 that attaches to the threads 44 formed on the threaded shaft 42. The flange nut 36 includes a planar inside surface 37 configured to press against the outside surface of the receptacle. The inside surface 37 may be flat or include a plurality of projections configured to grip a plastic bag.

Figure 2:
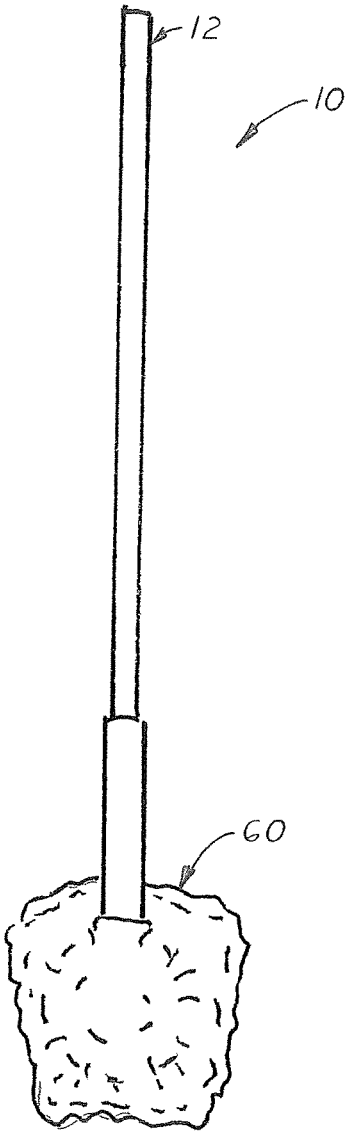
FIG. 2 is a front elevational view of the tool with a bag attached thereto show in FIG. 1.
Figure 3:
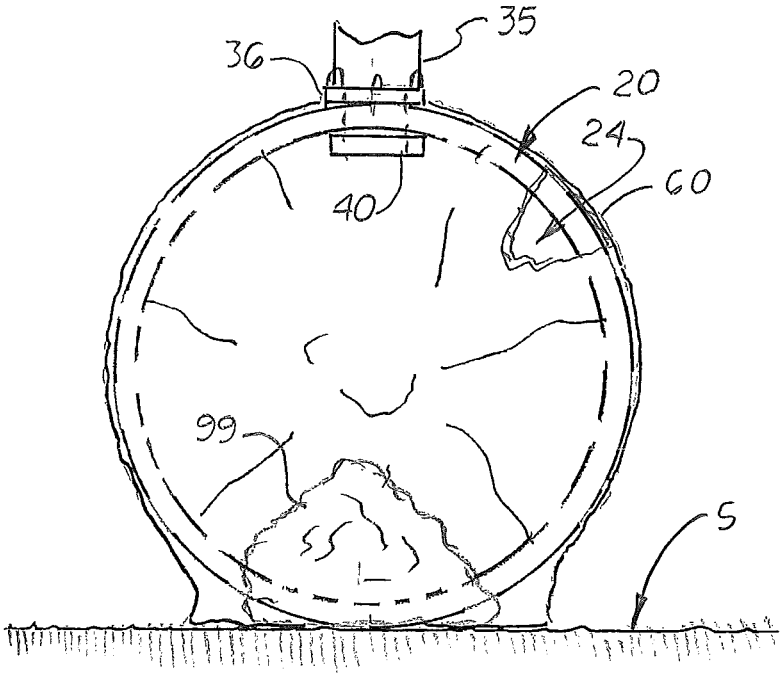
FIG. 3 is a front elevational view of the sleeve with a disposable bag attached thereto and positioned behind animal waste deposited on a grass surface.
Figure 4:
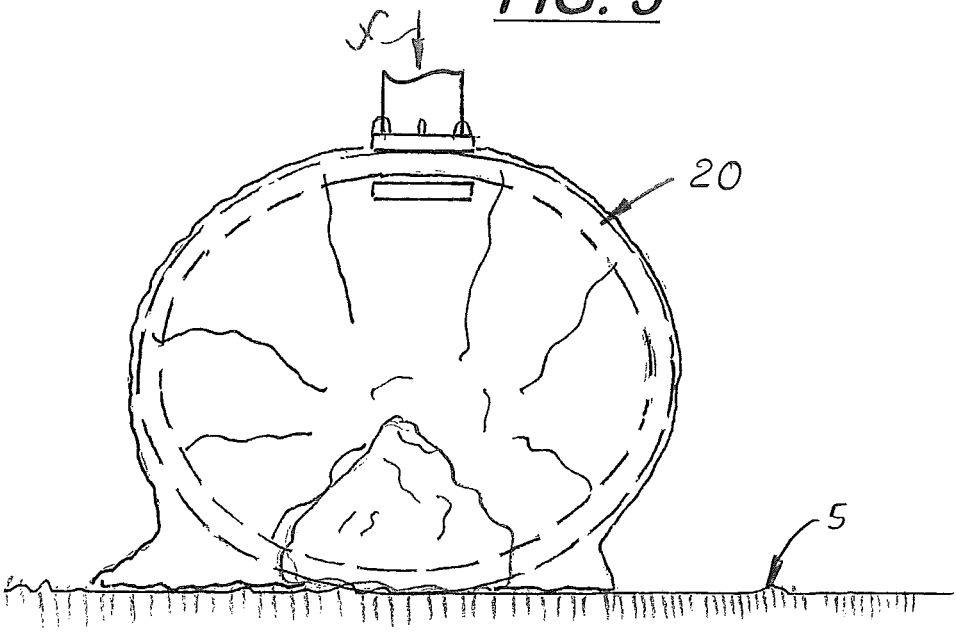
FIG. 4 is a front elevational view of the tool showing light downward force being exerted on the pole causing the sleeve to transform into an oval cross-sectional configuration.

The flange nut 36 may be attached or integrally formed on the end of long or short handle 12. The handle 12 may be straight or slightly curved as shown in FIGS. 1 and 2. When used with a long handle 12, the tool 10 may pick up waste material 99 while standing.

When the threaded bore is attached to the shaft and the flange nut 36 is tightened on the shaft 42, the inside surface 37 of the flange nut 36 presses against the portion of the plastic bag 60 adjacent to the side hole 24 and the shaft 42. As the flange nut 36 is tightened further on the shaft 42, the portion of the plastic bag 60 under the flange nut 36 is pulled which tightens and twists the entire plastic bag 60 around the sleeve 20 in FIG. 1. If the plastic bag extends on opposite sides of the hole, the plastic bag is twisted on opposite sides.

Figure 6:
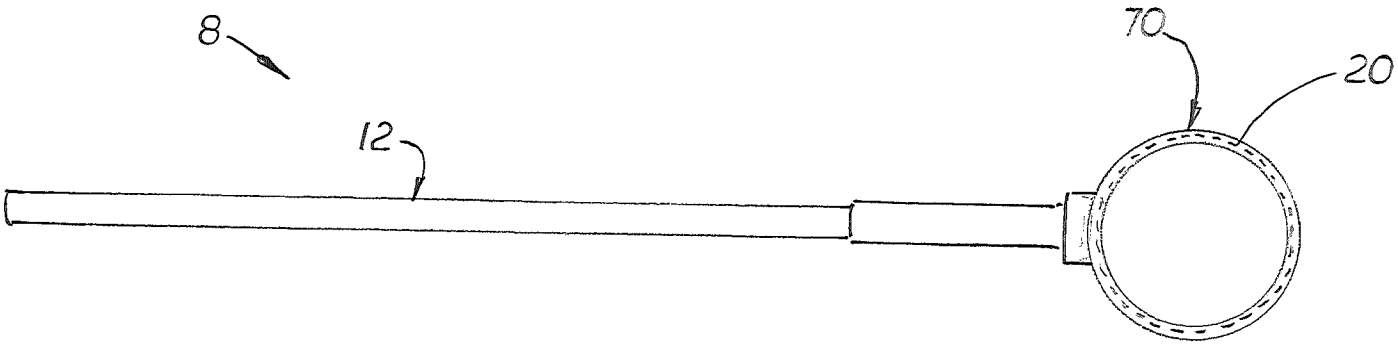
FIG. 6 is a top elevational view of tool used with a plastic bucket with a wide upper lip that rest against the top edge of the sleeve to hold the bucket in the sleeve.

FIG. 6 is a top elevational view of tool 10 in which the plastic bag 60 is replaced with a bucket 20. The bucket 70 includes a wide upper lip 72 that rest against the top edge of the sleeve 20 to hold the bucket 70 in the sleeve 20.

Figure 7:
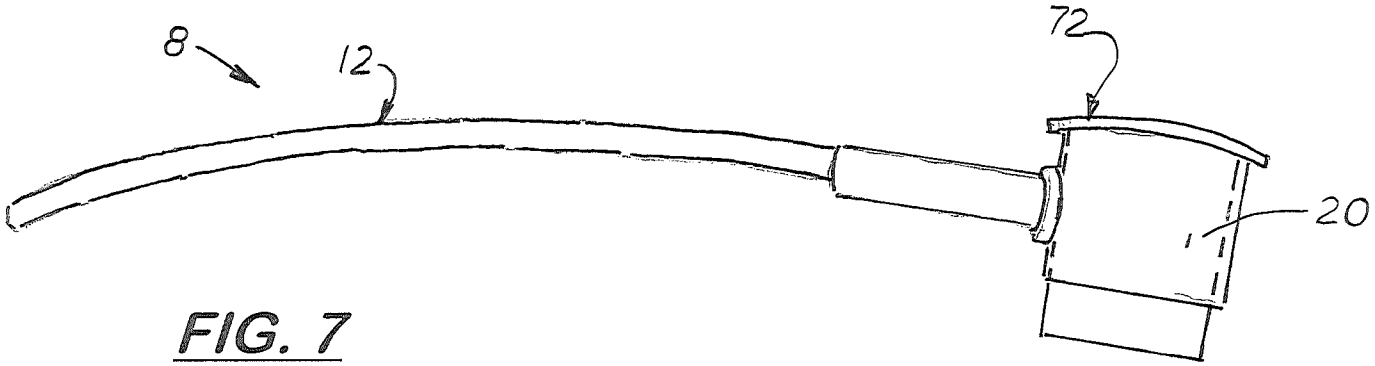
FIG. 7 is a side elevational view of the plastic bucket attached to the sleeve.

FIG. 7 is a side elevational view of the plastic bucket 70 attached to the sleeve 20.

Figure 8:
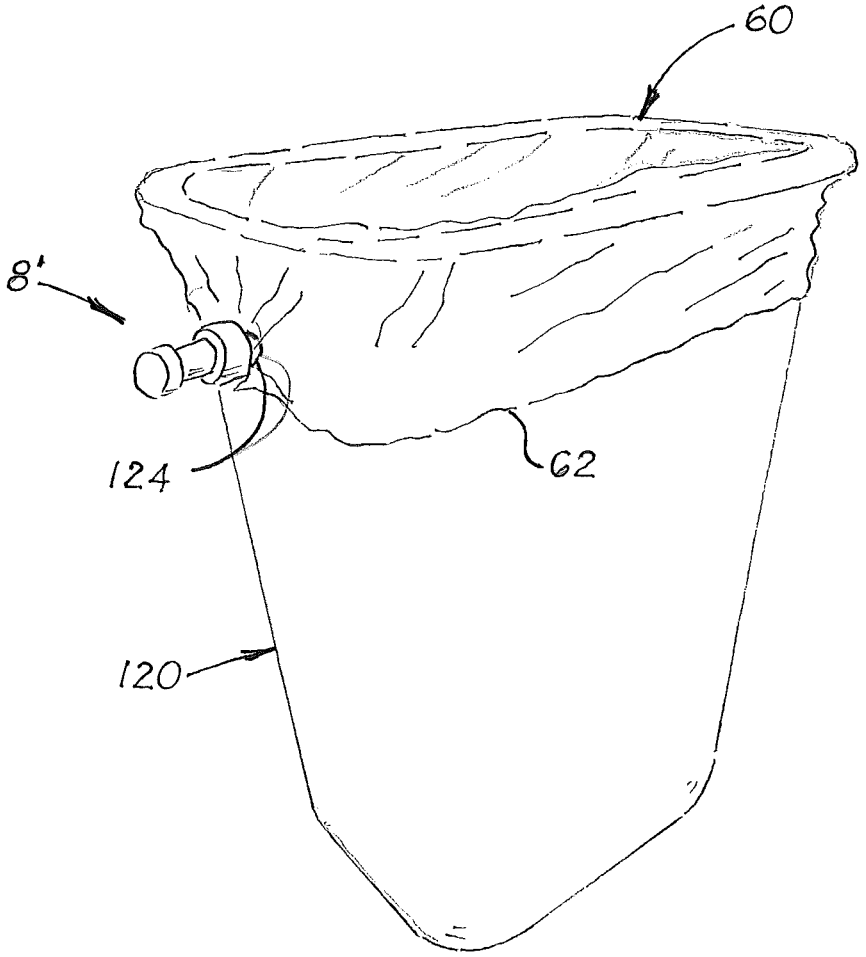
FIG. 8 is a front perspective view of a trash can with the second embodiment of the bag holder used as an accessory that enables air to escape from the space between a bag placed into the trash can when inserting the bag into the trash can, and securely holds and tightens the bag on the trash can.
Figure 9:
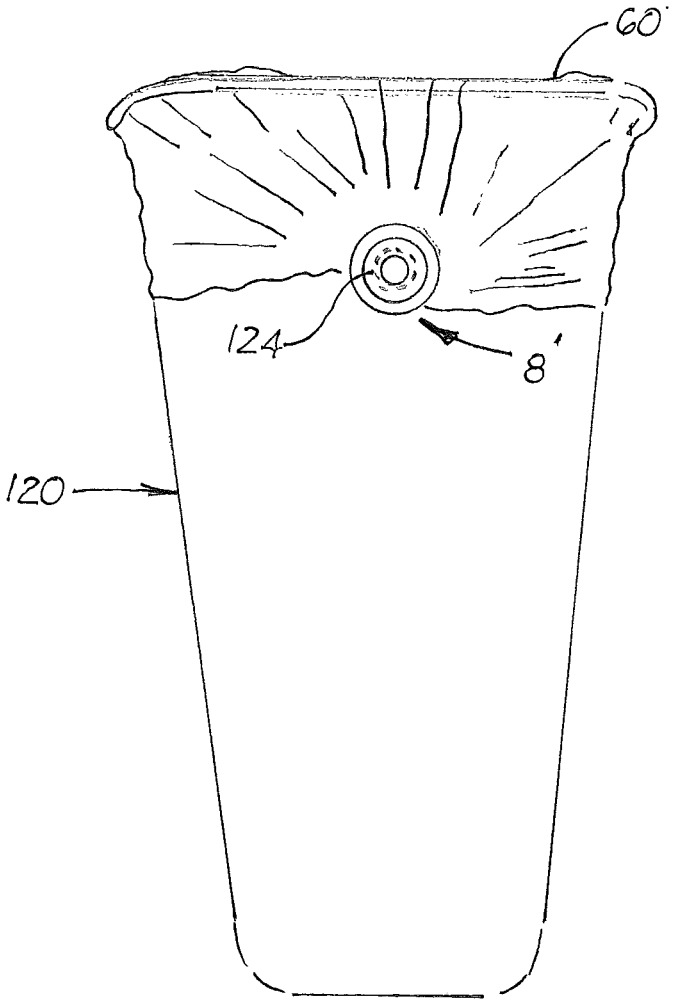
FIG. 9 is an end elevational view of a trash can with the holder used as a trash can accessory showing a bag held securely and tighten on the trash can.

FIGS. 8 and 9 is a front perspective view and a side elevational view, respectively, of a trash can 120 with the second embodiment of the holder 8' used as an accessory for holding a plastic bag 60' on the trash can 120 and also enables air to escape from the space 200 between the plastic bag 60' and the trash can 120 when inserting the plastic bag 60' into the trash can 120 and also securely holds the bag on the trash can 120.

Figure 10:
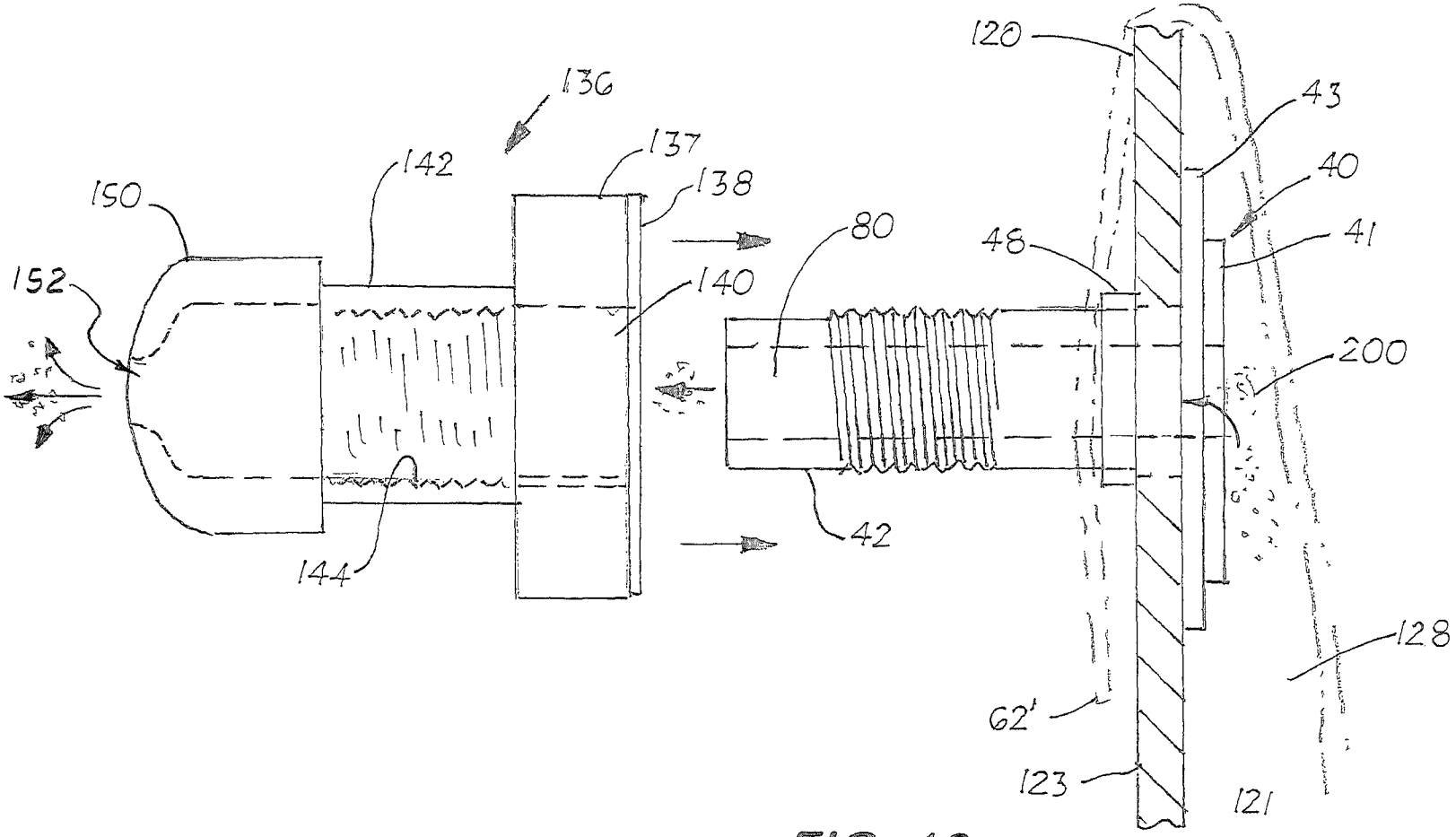
FIG. 10 is a side elevational view of the holder attached to the side wall of a trash can as shown in FIGS. 8 and 9 showing the flange nut be attached to the shaft.

As shown more clearly in FIG. 10, the holder 8' is similar to holder 8 in FIG. 5 and includes partially threaded bolt 40 designed to fit into the side hole 124 formed on the side of the trash can 120. The side hole 124 is located enough distance from the top edge of the trash can so the top edge 62' of plastic bag 60' folded downward over the outside surface of the trash can is located adjacent or near the side hole 124. The bolt 40 includes a wide head 41 and a perpendicularly aligned threaded shaft 42. The wide head 41 is placed on the inside surface 121 of the trash can 120 and the threaded shaft 42 extends outward through the side hole 124. When a plastic bag 60' is inserted through the trash can's top opening and into the center cavity, the top edge 62' of the plastic bag 60' is folded over the outside surface of the trash can 120 and placed adjacent to extended passed the shaft 42. Disposed on the shaft 42 and adjacent to the inside surface of the wide head 41 is an optional washer 43. Attached to the portion of the shaft 42 located adjacent to the outside surface of the trash can 120 is a lock washer or threaded bushing 48. During use the lock washer or threaded bushing 48 is tightened on the shaft 42 and forces against the outside surface of the trash can 120 to hold the shaft 42 securely in place on the trash can 120.

Formed in the shaft 42 is a longitudinally aligned air conduit 80. The air conduit 80 extends from the wide head 41 to the end of the shaft 42.

The holder 8' includes a wide flange nut 136 with a wide cylindrical body 137. Extending perpendicular from the body 137 is an intermediate member 142. The intermediate member 142 includes internal threads 138 configured to attach to the external threads formed on the shaft 42. The flange nut 136 includes an interior space 140 that accommodates the lock washer or lock bushing 48 allowing the outer inside surface 138 of the body 137 to press against the outside surface 123 of the trash can 120. The end cap 150 may be attached or formed on the intermediate member 142. The end cap 150 includes a hole 152 that communicates with the air conduit 80.

When used on a trash can 120, the air conduit 80 allows air 200 in the space 128 between the inside surface 121 of the trash can 120 and a plastic bag 60' when placed into the trash can 120 to escape enabling the plastic bag 60' expand into the trash can 120.

When the flange nut 136 is tightened on the shaft 42, the inside surface 138 of the body 137 presses against the plastic bag 60' adjacent to the side hole 124 and the shaft 42. As the flange nut 136 is further tightened on the shaft 42, the portion of the plastic bag 60' under the inside surface 138 of the body 137 is twisted and pulled which tightens the entire plastic bag 61 around the plastic bag 60' as shown in FIGS. 8 and 9.

Figure 11:
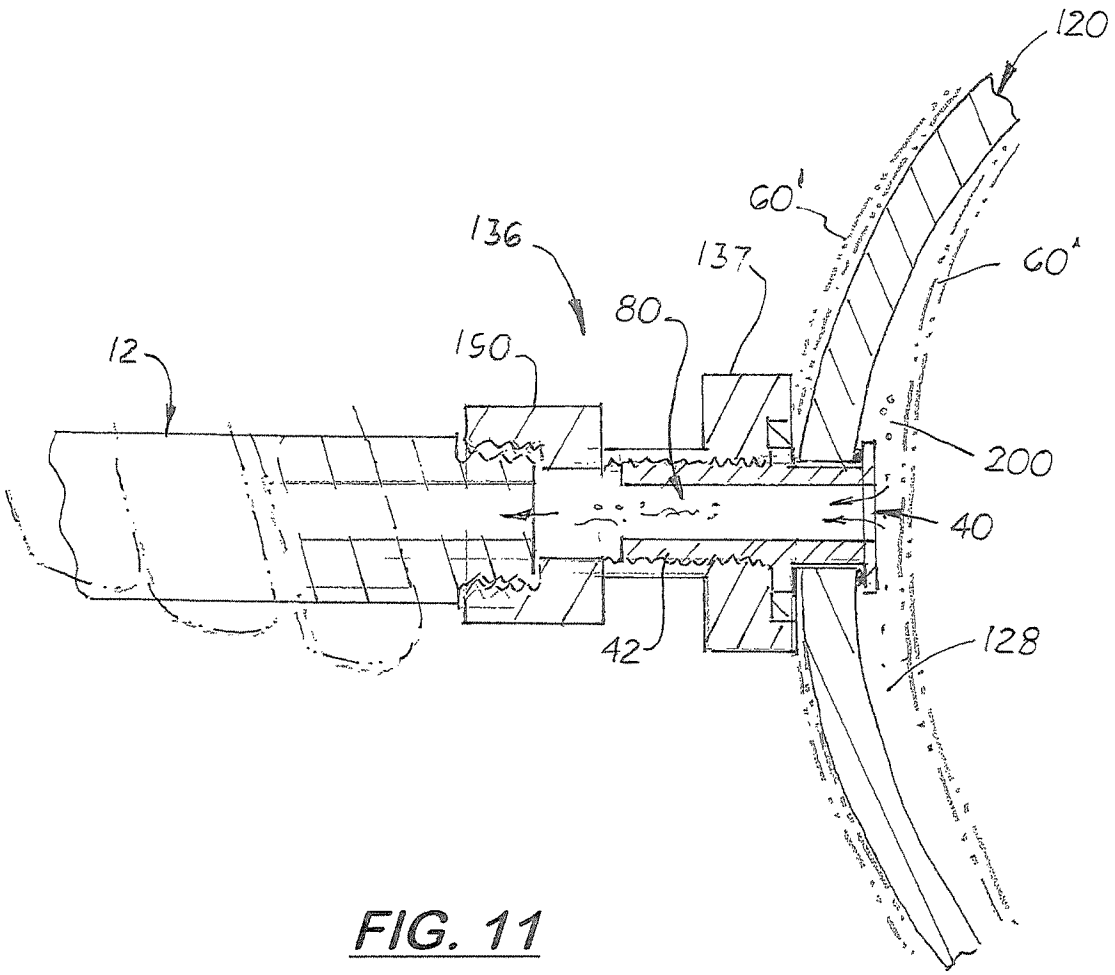
FIG. 11 is a sectional side elevational view of another embodiment of holder used with a thin wall sleeve or a cylindrical receptacle and showing an adapter attached to one end of the shaft that attaches to a handle that can be easily gripped by a user.

FIG. 11 is a sectional side elevational view of the second embodiment of the holder 8 used with a thin wall sleeve 20 that includes an adapter 150 attached to one end of the shaft 42. The adapter 150 may be attached to handle 12 that can be gripped by a user that allows the trash can 120 to be easily transported and, and if desired, turned upside down without detaching the bag 60' from the trash can 60'.

Figure 12:
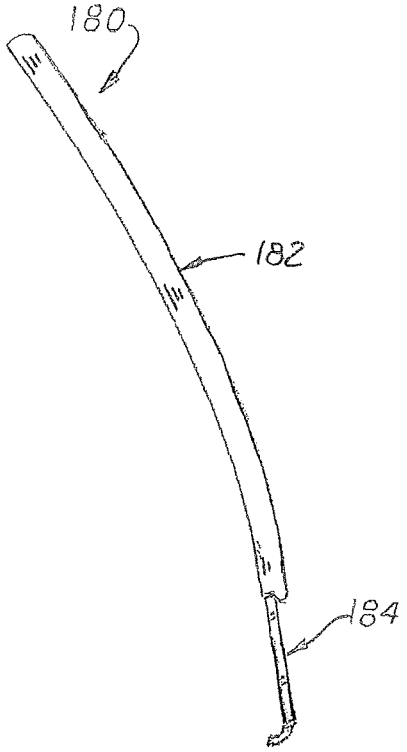
FIG. 12 is a side elevational view of an optional shovel used with the embodiments of the apparatus in FIGS. 1-4, 6 and 7.
Figure 13:
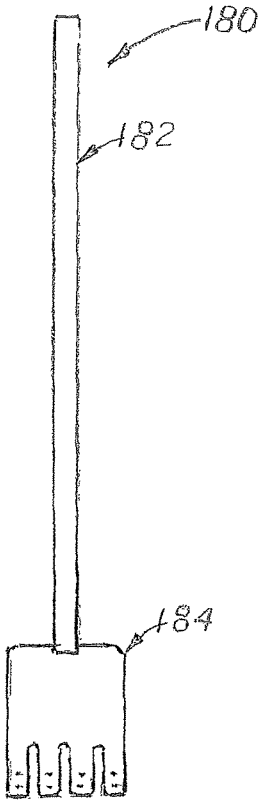
FIG. 13 is a front elevational view of the shovel in FIG. 12.

When the holder 8 is assembled into an animal waste bag holder tool 10, it may be desirable to distribute the tool 10 with an elongated scooping tool 180. As shown in FIGS. 12 and 13, the scooping tool 180 includes a straight or curved elongated handle 182 with a claw member 184 attached at its distal end. During use, the user may use the tool to flick animal waste material 99 into the plastic bag 60 or bucket 70.

The flange nut 36, 136 must be enough in diameter to grip a sufficient portion of the plastic bag adjacent to the side hole when forced against the outside surface of sleeve or trash can. The side holes 24, 124 formed on the sleeve and trash can are slightly larger in diameter than the shafts to allow the shafts on the bolts to slide freely. In the embodiments shown, the shafts are approximately ½ to ¾ in diameter. The flange nut 36 136 has as a complimentary threaded bore. The diameter of the flange nut is 1 to 2 inches in diameter. It should be understood, that the actual diameters of the shafts, bores and flange nuts may vary for different applications.

In compliance with the statute, the invention described has been described in language more or less specific on structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. A tool for picking up and depositing animal waste in a plastic disposable bag, comprising:

a. a cylindrical sleeve with a top opening, a bottom opening, a sidewall and a side hole formed on said sidewall;

b. a holder used to temporarily hold a plastic bag inside said cylindrical sleeve, said holder includes a bolt with a head, and a threaded shaft, said head being located inside said cylindrical sleeve and said shaft being extended through said side hole formed on said sidewall;

c. a lock washer that attaches to said shaft to hold said shaft inside said side hole; and d. a flange nut with internal threads that selectively attaches to said threaded shaft, said flange nut includes an inside surface that presses against said sidewall of said cylindrical sleeve when said flange nut is tighten on said threaded shaft, when said bag is extended into said top opening of said cylindrical sleeve and a top portion of said bag is extended over said sidewall and adjacent to said side hole, said flange nut is forced against said top portion of said bag extending over said sidewall to securely hold said bag on said cylindrical sleeve.

2. The tool as recited in claim 1, further including a handle attached to said flange nut.

* * * * *